United States Patent [19]

Sköld et al.

[11] Patent Number: 4,564,461

[45] Date of Patent: Jan. 14, 1986

[54] METHOD FOR THE MECHANICAL WORKING OF CAST IRON AND AN AQUEOUS CONCENTRATE TO BE USED IN THE METHOD

[75] Inventors: Rolf O. Sköld, Stenungsund; Lars-Gösta von Dahn, Hjälteby; Anna K. Sterky, Stenungsund, all of Sweden

[73] Assignee: Berol Kemi AB, Stenungsund, Sweden

[21] Appl. No.: 575,220

[22] Filed: Jan. 30, 1984

[30] Foreign Application Priority Data

Feb. 10, 1983 [SE] Sweden ..... 8300704

[51] Int. Cl.[4] ..... C10M 3/38

[52] U.S. Cl. ..... 252/32.5; 252/35; 252/49.3; 72/47

[58] Field of Search ..... 252/49.3, 32.5, 35; 422/13; 72/47

[56] References Cited

U.S. PATENT DOCUMENTS

| | | | |
|---|---|---|---|
| 3,265,620 | 8/1966 | Heiman | 252/33.6 |
| 3,966,619 | 6/1976 | Smith et al. | 252/49.3 |
| 4,129,509 | 12/1978 | Shringarpurey et al. | 252/49.5 |
| 4,218,329 | 8/1980 | Koh | 252/49.3 |

*Primary Examiner*—William R. Dixon, Jr.
*Assistant Examiner*—Cynthia A. Prezlock
*Attorney, Agent, or Firm*—Spencer & Frank

[57] ABSTRACT

Mechanical working of cast iron is performed in the presence of an aqueous metalworking composition containing an organic copper (II) complex and an iron corrosion inhibitor. An aqueous concentrate, which after dilution with water is suitable for application in mechanical working of cast iron, contains 1–50% copper (II) complex with such a $Cu^{2+}$-content of 0.5–20%, 1–50% iron corrosion inhibitor, 0–50% lubricant, 0–20% pH-regulators, bactericides and solubilizing agents and 10–70% water.

22 Claims, No Drawings

METHOD FOR THE MECHANICAL WORKING OF CAST IRON AND AN AQUEOUS CONCENTRATE TO BE USED IN THE METHOD

FIELD OF THE INVENTION

The present invention relates to a method for the mechanical working of cast iron, especially of so-called nodular or spheroidized iron. The working is performed in the presence of an aqueous metalworking composition containing a copper complex and a corrosion inhibitor. The invention further comprises an aqueous concentrate which, after dilution with water, can be used as a metalworking fluid for mechanical working of cast iron.

BACKGROUND OF THE INVENTION

Metalworking fluid compositions are well known in the art and function to lubricate and cool various metallic surfaces during metalworking operations such as cutting, turning, drilling, grinding, quenching and the like. For example, U.S. Pat. No. 4,129,509 discloses the use of a fluid emulsion containing a mineral oil and water. In order to stabilize the oil and water emulsion against attacks from bacteria and against degradation due to the metalworking conditions, the patent suggests the addition of an emulsifying agent and a metal complex of a heavy metal ion and a polyfunctional organic ligand. However, cutting fluids containing mineral oil cause problems when used for the machining of metals due to the formation of undesirable non-settling and highly viscous sludge in storage tanks, pumps and tubing. The presence of emulsifying agents aggravates this problem further. Thus, it is well known in the art that, for this reason, cutting fluids containing mineral oil are particularly unsuitable for use in the machining of cast iron, which produces large amounts of particulate contaminations.

Mechanical working of cast iron, especially of the quality usually called nodular or spheroidized graphite iron, is often performed in the presence of aqueous oil-free metalworking compositions such as the ones disclosed in U.S. Pat. No. 3,265,620. In connection with such compositions, however, a poisonous gas is generated, i.e. phosphine. The generation of phosphine is due to the fact that cast iron contains carbon (graphite) with inclusions of phosphorous material. When machining cast iron in the presence of water, this phosphorous material reacts to form phosphine.

To reduce the generation of phosphine it has been suggested, e.g. for cutting operations, to use metalworking compositions containing potassium permanganate which is a strong oxidizing agent. While this method has proved to reduce the generation of phosphine, the consequences have been severe corrosion attacks on machinery, tools, and machined iron. Furthermore, the compositions containing potassium permanganate are not stable, resulting in precipitations, primarily in the form of manganese ore.

SUMMARY OF THE INVENTION

Accordingly, it is an object of the present invention to eliminate these problems of the prior art.

It is another object of the present invention to provide an aqueous stable metalworking composition which prevents the formation of phosphine and which at the same time has good corrosion inhibiting and cooling properties.

It is yet another object of the present invention to provide a method for the mechanical working of cast iron in which is used such an aqueous stable metalworking composition.

These and other objects of the present invention are achieved by machining cast iron in the presence of an alkaline aqueous composition containing $Cu^{2+}$ bound as a complex. The suitable pH-range is 8–10. More specifically, the aqueous composition according to the present invention contains (a) an organic copper (II) complex, the content of copper complex being 0.05–2%; preferably 0.1–1% of the weight of the composition, and (b) a conventional corrosion inhibitor in the amount of 0.1–5%, preferably 0.2–3% of the weight of the composition. Normally, and preferably, the composition in accordance with the invention has the form of a clear solution.

DETAILED DESCRIPTION OF THE PREFERRED EMBODIMENTS

It is very surprising that a composition according to the present invention very effectively prevents the formation of phosphine, since the content of free $Cu^{2+}$ in such a system is extremely low. The use of a complexing agent prevents precipitation of copper, and $Cu^{2+}$ will be available as oxidizing agent. It is very important that the bivalent copper ions in the metalworking composition be available in the form of an organic chelate with sufficient complex stability in order to prevent the bonding of copper to other components in the composition, such as corrosion inhibitors and lubricants. It has been found that the corrosion protection is reduced if the corrosion inhibitor forms a complex with the copper ions. Furthermore, in case that $Cu^{2+}$ is precipitated, e.g., precipitation with corrosion inhibitors, lubricants, or other components present, the phosphine inhibiting ability is substantially lowered. The complexing agent must therefore have an ability to form a complex with $Cu^{2+}$ which is at least equivalent with the complexing ability of other components introduced into metalworking composition, such as corrosion inhibitors and lubricants.

Complexing agents according to the present invention are polyvalent carboxylic acids, such as oxalic acid, malonic acid, succinic acid, glutaric acid, adipic acid, maleic acid and fumaric acid; hydroxycarboxylic acids, such as citric acid and tartaric acid; aminocarboxylic acids, such as nitrilotriacetic acid (NTA), propylenediaminetetraacetic acid (PDTA) and ethylenediaminetetraacetic acid (EDTA); and alkanolamines, e.g. triethanolamine and diethanolamine. Especially suitable are complexing agents having a stability constant for the 1:1-complex with $Cu^{2+}$ within the range of $10^3$–$10^{17}$, and preferably within the range of $5 \cdot 10^3$–$10^{15}$. Examples of such preferred complexing agents are citric acid, nitrilotriacetic acid and triethanolamine.

The corrosion inhibitors suitable for use according to the present invention are agents normally used for corrosion inhibition of iron within the metalworking area, and containing at least one hydrophilic group. Suitable inhibitors are organic amines, e.g. alkanolamines, alkylamines, cyclic amines and polyamines; phosphate esters; carboxylic acids; and other agents having good corrosion inhibiting properties on iron. Some of the corrosion inhibitors, like triethanolamine, also have the ability to form a complex with copper. These special compounds can thus be applied in the function of corrosion inhibitors as well as of complexing agents, but they must be added in such amounts that they can accomplish both of their functions. A suitable amount of complexing agents is 0.04–3% by weight of the composition. Especially preferred corrosion inibitors according to the present invention are alkylarylsulfonamidocarboxylic acids, morpholine, triethanolamine or phosphate esters, such as those with the general formula:

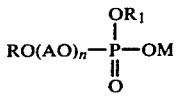

where R is a hydrocarbon group with 12–24 carbon atoms, AO is an alkyleneoxy with 2–3 carbon atoms, n is 0–10, preferably 1–6, M is hydrogen or a monovalent cation, and $R_1$ has the meaning of M or R.

A composition with excellent properties is obtained if triethanolamine, nitrilotriacetic acid or citric acid is chosen as complexing agent and used together with a conventional iron corrosion inhibitor such as an alkylarylsulfonamidocarboxylic acid, morpholine and/or a phosphate ester in combination with triethanolamine.

If desired, the aqueous composition according to the instant invention may also contain a lubricant, provided that the lubricant does not, in any considerable amount, form precipitates with $Cu^{2+}$. Preferably, the composition is essentially free from hydrocarbon components. Examples of suitable lubricants are conventional lubricants such as monocarboxylic acids, alkyl- or alkylarylsulphonates or -sulphates, alkylphosphates, alkylphosphonates, alkyl (polyoxyalkylene) phosphates or polyalkylene glycols. Many of these lubricants have also an excellent corrosion inhibiting capacity. The amount of lubricant may suitably be in the range of 0.03–3% by weight of the aqueous composition.

Besides complexing agents, corrosion inhibitors and lubricants, the aqueous metalworking composition may also contain pH-regulating agents, bactericides, perfumes, viscosity modifying agents and solubilizing agents, well known per se. The solubilizing agents are normally low-molecular hydroxylic compounds, such a monoethylethyleneglycol, propyleneglycol, butyldiethyleneglycol and ethyleneglycol.

When preparing a metalworking composition according to the present invention, it is advisable first to prepare a concentrate. Such a concentrate may be prepared by adding, to a suitable amount of water, a water-soluble copper salt, such as copper (II) acetate, the complexing agent(s) and the corrosion inhibitor(s). After this the other components are added under slight stirring. The amount of water in relation to the other components is chosen in such a way that a water content of about 10–70% by weight of concentrate is obtained. Typical formulations of the concentrate according to the present invention are as follows:

| | |
|---|---|
| $Cu^{2+}$-complex | 1–50%, preferably 2–30%, by weight |
| with a $Cu^{2+}$ content of | 0.5–20%, preferably 1–10%, by weight |
| Corrosion inhibitor | 1–50%, preferably 2–30%, by weight |
| Lubricant | 0–50%, preferably 1–30%, by weight |
| pH-regulators, | 0–20%, preferably |
| Bactericides, Solubilizing agents, etc. | 0–10%, by weight |
| Water | 10–70%, preferably 20–50%, by weight |

Before application, the concentrate is diluted with water in order to obtain a working solution with water content of 99.5–85% by weight. The resulting working solution should have an organic copper (II) complex concentration of 0.05 to 2 percent by weight and a corrosion inhibitor concentrate of 0.1 to 5 percent by weight.

The present invention is illustrated, without limitation, by the following examples:

EXAMPLE

A number of concentrates were prepared by adding copper (II)-acetate to water and, thereafter, corrosion inhibitors and lubricants according to the table below. The concentrates were then diluted with water to obtain an amount corresponding to ten times their own weight. Compositions A and B are comparison compositions. The composition B has a formulation in accordance with the U.S. Pat. No. 4,129,509.

| Composition | Components | Content, weight % |
|---|---|---|
| 1 | $Cu^{2+}$-acetate.$H_2O$ | 0.5 |
| | Triethanolamine | 4.0 |
| | Water | Rest |
| 2 | $Cu^{2+}$-acetate.$H_2O$ | 0.5 |
| | Triethanolamine | 0.8 |
| | Alkylphenylsulfonamido-carboxylic acid | 0.45 |
| | Water | Rest |
| 3 | $Cu^{2+}$-acetate.$H_2O$ | 0.5 |
| | Triethanolamine | 0.8 |
| | Alkylphenylsulfonamido-carboxlyic acid | 0.45 |
| | Morpholine | 1.8 |
| | Water | Rest |
| 4 | $Cu^{2+}$-acetate.$H_2O$ | 0.5 |
| | Triethanolamine | 0.8 |
| | $C_{18}$-alkyldi (propyleneoxy) phosphate | 2.2 |
| | Water | Rest |
| 5 | $Cu^{2+}$-acetate.$H_2O$ | 0.5 |
| | Triethanolamine | 2.6 |
| | Pelargonic acid | 0.5 |
| | Water | Rest |
| 6 | $Cu^{2+}$-acetate.$H_2O$ | 0.1 |
| | NTA | 0.1 |
| | $C_{18}$-alkyldi (oxypropylene) phosphate | 0.75 |
| | Triethanolamine | 0.25 |
| | Water | Rest |
| 7 | $Cu^{2+}$-acetate.$H_2O$ | 0.25 |
| | NTA | 0.25 |
| | $C_{18}$-alkyldi (oxypropylene)-phosphate | 0.75 |
| | Triethanolamine | 0.25 |
| | Water | Rest |
| 8 | $Cu^{2+}$-acetate.$H_2O$ | 0.5 |
| | NTA | 0.5 |
| | $C_{18}$-alkyldi (oxypropylene)-phosphate | 0.75 |
| | Triethanolamine | 0.25 |
| | Water | Rest |
| 9 | $Cu^{2+}$-acetate.$H_2O$ | 1.0 |
| | NTA | 1.0 |
| | $C_{18}$-alkyldi (oxypropylene) phosphate | 1.5 |
| | Triethanolamine | 0.5 |

-continued

| Composition | Components | Content, weight % |
|---|---|---|
| | Water | Rest |
| 10 | $Cu^{2+}$-acetate.$H_2O$ | 0.5 |
| | Triethanolamine | 0.8 |
| | Citric acid (monohydrate) | 0.6 |
| | $C_{18}$-alkyldi (oxypropylene) phosphate | 1.6 |
| | Water | Rest |
| A | Potassium permanganate | 1.0 |
| | Triethanolamine | 0.5 |
| | $C_{18}$-alkyldi (oxypropylene) phosphate | 1.2 |
| | Water | Rest |
| B | Organomet ($Cu^{2+}$-citrate) from Coolant Control Inc. | 0.1 |
| | Mineral Oil | 5.0 |
| | Water | Rest |

Five grams of nodular iron chips produced by dry turning were placed in a test glass having a piece of cotton on bottom. Three milliliters of one of the fluid compositions above was poured over the chips and the test glass was placed into a water bath at 80° C. After a reaction time of 5 minutes, 1 liter air was pumped through the test glass and the amount of phosphine in the air was measured by passing the air through an analysis tube containing a reagent which becomes colored by phosphine (Dräger Phosphine 0.1/a). The tube was graded from 0 to 4 ppm for an air amount of 1 liter.

The same type of iron chips were also used for a corrosion test. This was carried out by placing 30 g of chips on a filter paper in a Petri-dish containing 1.25 ml of the fluid. After 24 hours, the corrosion was determined by placing a transparent film with a grid over the filter paper and the occurrence of corrosion was determined for every point of intersection on the grid. The corrosion was determined as the ratio between the points of intersection with corrosion and the whole number of points of intersection. The following results were obtained.

| Test | ppm phosphine | % corrosion |
|---|---|---|
| 1 | 0.1 | 8 |
| 2 | less than 0.1 | 6 |
| 3 | 0.1 | 4 |
| 4 | 0.1 | 0 |
| 5 | 0.1 | 5 |
| 6 | 0.6 | 0 |
| 7 | 0.4 | 0 |
| 8 | 0.1 | 0 |
| 9 | 0.1 | 2 |
| 10 | 0 | 0 |
| A | 0.5 | more than 20 |
| B | 3.0 | not measured |

From the above results, it is evident that the released amount of phosphine, by applying the method according to the present invention, is very low. If the working had been performed without the presence of a phosphine reducing component, the amount of phosphine would have been about 3 ppm. The corrosion test shows that the compositions 1–10 also cause a remarkably low corrosion, particularly when the preferred amounts of components are present.

It will be obvous to those skilled in the art that various changes may be made wthout departing from the scope of the invention and the invention is not to be considered limited to what is described in the specification.

What is claimed is:

1. In a method for the mechanical working of cast iron comprising mechanically working the cast iron in the presence of an alkaline aqueous metalworking composition, the improvement wherein said metalworking composition is essentially free of mineral oil and comprises:

an organic copper (II) complex in an amount of 0.05–2% by weight of the composition; and an iron corrosion inhibitor in an amount of 0.1–5% by weight.

2. A method in accordance with claim 1, wherein said copper (II) complex includes a complexing agent which has a stability constant of $10^3$–$10^{17}$ for a 1:1 complex with $Cu^{2+}$.

3. A method in accordance with claim 2, wherein the stability constant of said complexing agent is $5 \cdot 10^3$–$10^{15}$ for a 1:1 complex with $Cu^{2+}$.

4. A method in accordance with claim 1, wherein said copper (II) complex includes, as the complexing agent thereof, citric acid, nitrilotriacetic acid, triethanolamine or a mixture thereof.

5. A method in accordance with claim 2, wherein said complexing agent is citric acid, nitrilotriacetic acid, triethanolamine or a mixture thereof.

6. A method in accordance with claim 1, wherein said iron corrosion inhibitor is selected from the group consisting of alkylarylsulfonamidocarboxylic acids, morpholine, triethanolamine, phosphate ester, and mixtures thereof.

7. A method in accordance with claim 1, wherein said iron corrosion inhibitor is selected from the group consisting of alkylarylsulfonamidocarboxylic acid, morpholine, triethanolamine, a phosphate ester of the formula:

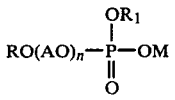

where R is a hydrocarbon group with 12–24 carbon atoms, AO is an alkyleneoxy group with 2–3 carbon atoms, n is 0–10, M is hydrogen or a monovalent cation and $R_1$ has the meaning of M or R,
and mixtures thereof.

8. A method in accordance with claim 2, wherein said iron corrosion inhibitor is selected from the group consisting of alkylarylsulfonamidocarboxylic acid, morpholine, triethanolamine, a phosphate ester of the formula:

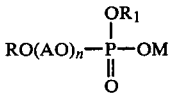

where R is a hydrocarbon group with 12–24 carbon atoms, AO is an alkyleneoxy group with 2–3 carbon atoms, n is 0–10, M is hydrogen or a monovalent cation and $R_1$ has the meaning of M or R,
and mixtures thereof.

9. A method in accordance with claim 4, wherein said iron corrosion inhibitor is selected from the group consisting of alkylarylsulfonamidocarboxylic acid, morpholine, triethanolamine, a phosphate ester of the formula:

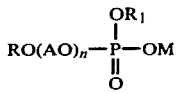

where R is a hydrocarbon group with 12–24 carbon atoms, AO is an alkyleneoxy group with 2–3 carbon atoms, n is 0–10, M is hydrogen or a monovalent cation and $R_1$ has the meaning of M or R,
and mixtures thereof.

10. A method in accordance with claim 7, wherein said corrosion inhibitor at least partly consists of a combination of triethanolamine and one or more corrosion inhibitors selected from the group consisting of alkylarylsulfonamidocarboxylic acid, morpholine and said phosphate ester.

11. A method in accordance with claim 8, wherein said corrosion inhibitor at least partly consists of a combination of triethanolamine and one or more corrosion inhibitors selected from the group consisting of alkylarylsulfonamidocarboxylic acid, morpholine and said phosphate ester.

12. A method in accordance with claim 9, wherein said corrosion inhibitor at least partly consists of a combination of triethanolamine and one or more corrosion inhibitors selected from the group consisting of alkylarylsulfonamidocarboxylic acid, morpholine and said phosphate ester.

13. A method in accordance with claim 7, wherein in said phosphate ester, n is 1–6.

14. A method in accordance with claim 1, wherein said copper (II) complex includes a complexing agent which is the same substance as said iron corrosion inhibitor.

15. A method in accordance with claim 14, wherein the substance constituting said complexing agent and said iron corrosion inhibitor is triethanolamine.

16. A metalworking composition concentrate, which is essentially free of mineral oil suitable for use, after dilution with water, in the mechanical working of cast iron, comprising:

organic copper (II) complex: 1–50% by weight
with a $Cu^{2+}$ content of: 0.5–20% by weight
iron corrosion inhibitor: 1–50% by weight
lubricant: 0–50% by weight
pH-regulator, bactericides and solubilizing agents: 0–20% by weight
water: 10–70% by weight.

17. A metalworking composition concentrate in accordance with claim 16, wherein the amount of said copper (II) complex is 2–30% by weight with a $Cu^{2+}$ content of 1–10% by weight, said corrosion inhibitor is present in 2–30% by weight, said lubricant is present in 1–30% by weight, said pH-regulators, bactericides and solubilizing agents are present in 0–10% by weight, and water is present in 20–50% by weight.

18. A metalworking composition concentrate in accordance with claim 17, wherein said lubricant is present in the amount of 1–30% by weight and is selected from monocarboxylic acids, alkylsulphonates, alkylarylsulphonates, alkylsulphates, alkylarylsulphates, alkylphosphates, alkylphosphonates, alkyl(polyoxyalkylene) phosphates and polyalkylene glycols.

19. A metalworking composition concentrate in accordance with claim 16, wherein said copper (II) complex includes a complexing agent selected from the group consisting of citric acid, nitrilotriacetic acid, triethanolamine and a mixture thereof.

20. A metalworking composition concentrate in accordance with claim 16, wherein said iron corrosion inhibitor is selected from the group consisting of alkylarylsulfonamidocarboxylic acid, morpholine, triethanolamine, a phosphate ester of the formula:

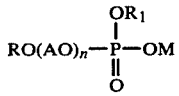

where R is a hydrocarbon group with 12–24 carbon atoms, AO is an alkyleneoxy group with 2–3 carbon atoms, n is 0–10, M is hydrogen or a monovalent cation and $R_1$ has the meaning of M or R,
and mixtures thereof.

21. A metalworking composition, which is essentially free of mineral oil, suitable for use in the mechanical working of cast iron, comprising:

organic copper (II) complex: 0.05–2% by weight
iron corrosion inhibitor: 0.1–5% by weight
lubricant: 0–3% by weight
water: 85–99.5% by weight.

22. A metalworking composition in accordance with claim 21, wherein said copper (II) complex includes a complexing agent selected from the group consisting of citric acid, nitrilotriacetic acid, triethanolamine and a mixture thereof and said iron corrosion inhibitor is selected from the group consisting of alkylarylsulfonamidocarboxylic acid, morpholine, triethanolamine, a phosphate ester of the formula:

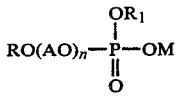

where R is a hydrocarbon group with 12–24 carbon atoms, AO is an alkyleneoxy group with 2–3 carbon atoms, n is 0–10, M is hydrogen or a monovalent cation and $R_1$ has the meaning of M or R,
and mixtures thereof.

* * * * *